United States Patent [19]

Rigg

[11] Patent Number: 4,775,257

[45] Date of Patent: Oct. 4, 1988

[54] FLACCID LACE LOOSE-LEAF BINDER

[76] Inventor: Richard S. Rigg, 2520 Moorpark Ave., San Jose, Calif. 95218

[21] Appl. No.: 93,588

[22] Filed: Sep. 4, 1987

[51] Int. Cl.[4] ..... B42F 13/04

[52] U.S. Cl. ..... 402/9; 402/8; 402/12

[58] Field of Search ..... 402/8,9,10,11

[56] References Cited

U.S. PATENT DOCUMENTS

| | | | |
|---|---|---|---|
| 28,755 | 6/1860 | Jacobs | 402/9 |
| 43,696 | 8/1864 | Maynard | 402/9 |
| 91,268 | 6/1869 | Richard | 402/9 |
| 148,908 | 3/1874 | Whitehall | 402/7 |
| 149,790 | 4/1874 | Reid | 402/9 |
| 150,520 | 5/1874 | Bullinger | 402/9 |
| 157,869 | 12/1874 | Reid | 402/10 |
| 160,419 | 3/1975 | Goldsmith | 402/7 |
| 194,230 | 8/1877 | England | 402/9 |
| 197,469 | 11/1877 | Hobart | 402/7 |
| 267,975 | 11/1882 | Dewey | 402/12 |
| 395,552 | 1/1889 | Dornbirer | 402/9 |
| 416,621 | 12/1889 | Howd | 402/8 |
| 478,695 | 7/1892 | Harvey/Grundy | 402/9 |
| 484,267 | 10/1892 | Westrup | 402/9 |
| 594,203 | 11/1897 | Gilson | 402/12 |
| 661,213 | 11/1900 | Fitch | 402/9 |
| 664,544 | 12/1900 | Gilson | 402/12 |
| 911,125 | 2/1909 | Griesinger | 402/9 |
| 1,322,344 | 11/1919 | Reschke | 402/12 |
| 1,644,541 | 5/1925 | Owen | 402/8 |
| 2,731,967 | 7/1952 | Allison | 402/12 |
| 3,261,066 | 7/1966 | Chamberlin | 402/8 |
| 4,693,624 | 9/1987 | Moosmüller | 402/9 X |

FOREIGN PATENT DOCUMENTS

| | | | |
|---|---|---|---|
| 154514 | 6/1952 | Australia | 402/9 |
| 1134657 | 8/1962 | Fed. Rep. of Germany | 402/8 |
| 802577 | 10/1958 | United Kingdom | 402/9 |
| 2114059 | 8/1983 | United Kingdom | 402/8 |

*Primary Examiner*—Paul A. Bell

*Attorney, Agent, or Firm*—Thomas Schneck

[57] ABSTRACT

An expandable loose-leaf binder for releaseable insertion of perforated paper sheets consisting of two separate perforated covers joined by means of separate flaccid lace sheet retainers. Each retainer has a small, capsule-shaped connector which can be drawn through the sheet perforations and opened at any place in the binder to insert a sheet. An elastic band which may be adjusted or removed without releasing the retainers is used to take up slack.

14 Claims, 3 Drawing Sheets

FLACCID LACE LOOSE-LEAF BINDER

BACKGROUND—FIELD OF INVENTION

This invention relates to loose-leaf binders for the releaseable insertion of perforated sheets, especially to binders with flaccid lace sheet retainers.

BACKGROUND—DESCRIPTION OF PRIOR ART

Heretofore flaccid cord or lace retainers have been widely used to bind together perforated paper sheets. However, no lace sheet retainer of prior art permits the insertion of standard three-hole binder paper anywhere in the binder without having to remove other sheets first. Prior attempts to solve this problem by making small slits or cuts in the paper from the holes to the outside edge are impractical. The extra cuts weaken the perforations and the paper comes loose easily. Other binder systems, such as steel ring binders, solve the problem, but in so doing they lose many of the advantages of the flaccid lace.

Many prior art flaccid lace binders use an elastic tension band to take up slack in the lace and clamp the sheets tightly between the covers. However, they cannot be quickly and easily connected and disconnected without untying the retainers, nor can they be adjusted to vary the tension according to the amount of paper in the binder. This is no problem if the binder is to be used primarily as a file for documents occasionally referred to, but it is too inflexible for a student binder and notebook. In a student binder the tension band should be capable of adjustment so that pages turn smoothly no matter how many sheets are in the binder. If the pages are being flipped back and forth or turned over 360 degrees front cover to back cover while taking lecture notes, studying, or typing a report, it is a great advantage to be able to disconnect the tension band altogether for the moment, making of the binder a loose, floppy collection of perforated sheets held in their proper order by the slack retainers.

OBJECT OF INVENTION

The object of this invention is to provide students with an inexpensive, expandable, flaccid lace loose-leaf binder for perforated sheets (standard three-hole binder paper) with lace sheet retainers which permit the releaseable insertion of sheets at any place in the binder without having to remove other sheets first.

Another object of this invention is to provide a flaccid lace loose-leaf binder with an elastic tension band which can easily be adjusted while under tension or removed to give the lace more slack without releasing the lace altogether.

Another object of this invention is to provide a lacing needle for flaccid lace retainers which can be connected to the lace to facilitate the binding of a stack of perforated sheets and then removed and stored in the binder in an out-of-the-way place.

Another object is to provide a flaccid lace loose-leaf binder with a back identification strip which slips out of the way when the binder is opened and does not restrict the opening of the binder in any way.

ADVANTAGES OF THE INVENTION

With retainers twenty centimeters in length, this binder will easily hold 350 sheets. It expands as sheets are inserted and contracts when they are removed.

Therefore, it never has a wedge shape, stacks neatly with other books, and wastes no space in a briefcase or backpack or on a library shelf. The thin empty binders will be very economical to ship, and because it is so simply made, it will make a very inexpensive student binder.

Pages may be inserted or removed at any place in the binder without having to remove other sheets first. The removeable lacing needle facilitates the insertion of many sheets at one time.

The elastic slack take-up band can be adjusted while it is hooked to the retainers, or it can be removed altogether without releasing the retainers, thereby providing a range of tension from a tightly bound volume to a moderately loose and floppy one. With the tension adjusted to suit the number of pages in the binder, the pages will turn easily but still be firmly bound together. With the band temporarily disconnected, they can be flipped back and forth still more easily, especially 360 degrees, front cover to back.

Both covers and all sheets save one may be opened to one side, leaving the one sheet flat on the desk for neat, comfortable writing without having to remove it from the binder.

The binder can be opened so that two adjacent sheets are level and with their edges touching so that a graph, chart, or table can be drawn and read across both sheets as if they were one sheet of paper. Or a double sheet may be folded, punched on the folded edge, and inserted like a single sheet. It will open out neat and flat, and the flat lace retainers will offer little or no interference.

Any number, size, and arrangement of retainers and tension bands and any size covers and perforated sheets may be used to make a binder or folio for any purpose. For example, architectural prints and drawings may be folded in half and bound like the above mentioned double sheets. Accordian-folded computer printouts may also be bound in similar fashion. Several sheet retainers may be joined together to make a longer retainer.

Books, manuals, syllabi, references, directories, etc. which might need revision or updating could well be bound with this system.

The reader will find still other advantages and uses for this binding system from a consideration of the ensuing description and accompanying drawings.

DRAWING REFERENCE NUMERALS

Figure 1:
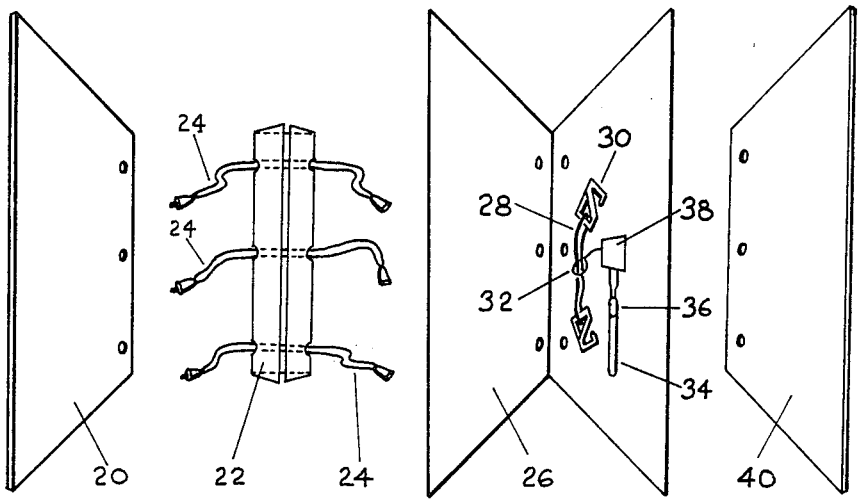
FIG. 1 shows a perspective view of the components of the binder in the order of their assembly.

20 top cover 22 back identification strip
24 sheet retainers
26 tension band folder
27 added thickness on alternate tension band folder
28 elastic tension band
29 tension band channel on alternate folder
30 tension band hooks
31 slit in hooks for band adjustment
32 tension band holder
34 lacing needle
36 lacing needle holder
37 lacing needle holder on alternate tension band folder
38 tape
40 bottom cover
42 male part of lace connector
44 female part of lace connector
46 plastic sleeves around lace ends
48 cogs on alternate male part of lace connector
50 grooves on alternate female part of lace connector
52 locking channel on alternate female part of lace connector
100 bound perforated sheets

FLACCID LACE LOOSE-LEAF BINDER DESCRIPTION

FIG. 1 shows a perspective view of the components of the invention, comprising a perforated top cover 20, a perforated back identification strip 22, lace sheet retainers 24, perforated tension band folder 26, tension band 28, tension band hooks 30, tension band holder 32, lacing needle 34, lacing needle holder 36, tape 38, and perforated bottom cover 40. The covers are preferably of 3 mm thick cardboard. The tension band folder is a manila folder, and the back identification strip is of the same material. The long sides of the strip are folded towards the center, and holes are punched on the folds. Retainers are then laced through the holes and the folded edges taped together. The lacing needle is plastic, 5 mm in diameter and 8 cm long. The needle is threaded to match a corresponding connector part on one end of a retainer. The lacing needle holder is one end of a retainer (the connector part and a piece of lace), and the tension band holder is a piece of string. Both holders are taped to the folder.

Figure 2:
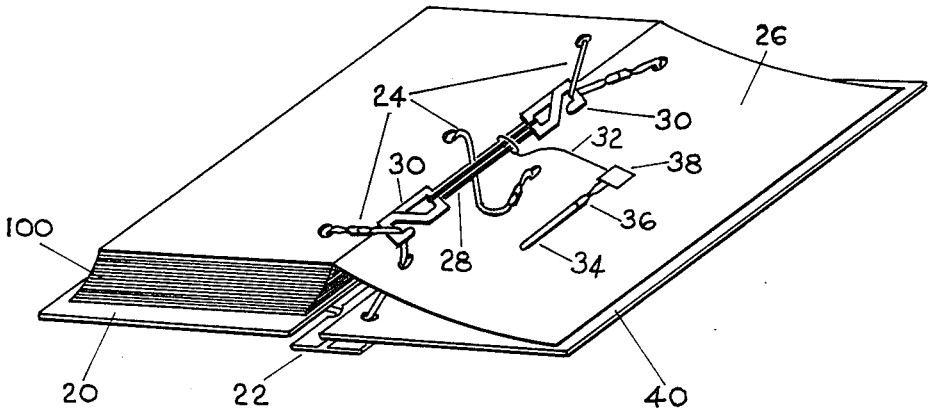
FIG. 2 is a perspective view of the binder holding a bound stack of perforated sheets and opened at the tension band folder.

FIG. 2 is a perspective view of a binder opened at the tension band folder and showing the top cover 20, identification strip 22, sheet retainers 24, tension band folder 26, tension band 28, tension band hooks 30, tension band holder 32, lacing needle 34, lacing needle holder 36, bottom cover 40, and a bound stack of perforated sheets 100. The covers, the tension band folder, and identification strip are all bound together along with the perforated sheets by means of the lace sheet retainers.

Figure 3:
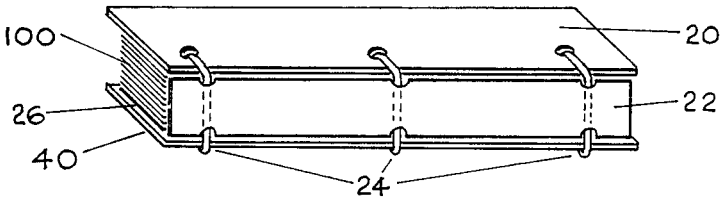
FIG. 3 is a perspective view of the binder with bound sheets as seen from the back.

FIG. 3 is a perspective view of a closed binder showing the top cover 20, identification strip 22, sheet retainers 24, tension band folder 26, bottom cover 40, and bound stack of perforated sheets 100.

Figure 4:
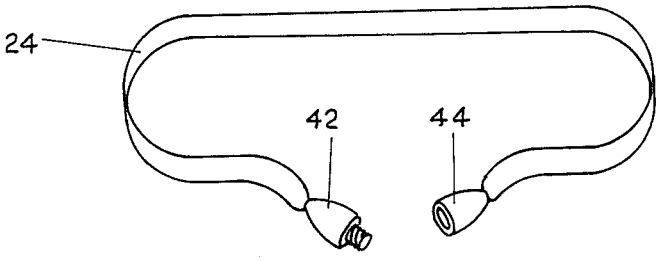
FIG. 4 is an open flaccid lace sheet retainer.

FIG. 4 shows a flaccid lace sheet retainer according to the preferred embodiment of the invention. When joined together, the threaded male part 42 and the threaded female part 44 form a smooth, capsule-shaped connector 5 mm in diameter and 15 mm long. The connector is preferably of molded plastic. The lace 24 is of woven, tubular shoelace material about 6 mm wide and 180 mm long.

Figure 5:
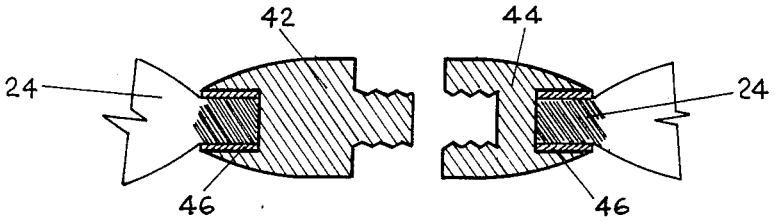
FIG. 5 is a longitudinal section through the connector parts showing how they are fastened to the lace ends.

FIG. 5 shows a longitudinal section through the center of the male 42 and the matching female 44 connector parts. The ends of the lace 24 are bound in plastic sleeves 46 and glued into holes in the connector parts.

Figure 6:
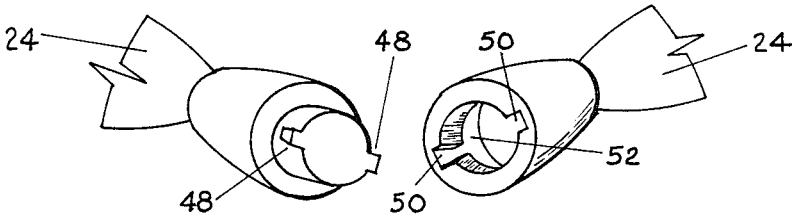
FIG. 6 shows an alternate method of joining the connector parts together.

FIG. 6 shows an alternate connector design. Cogs 48 on the male part slide into grooves 50 on the female part and lock into channel 52.

Figure 7:
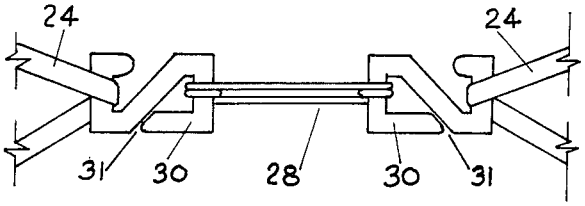
FIG. 7 shows a tension band hooked to two opposing retainers.

FIG. 7 shows an elastic tension band. A rubber band 28 is slipped through slits 31 in flat plastic hooks 30 and, if necessary to increase tension, wound several times around the book. The hooks are shown hooked over two opposing sheet retainers 24.

Figure 8:
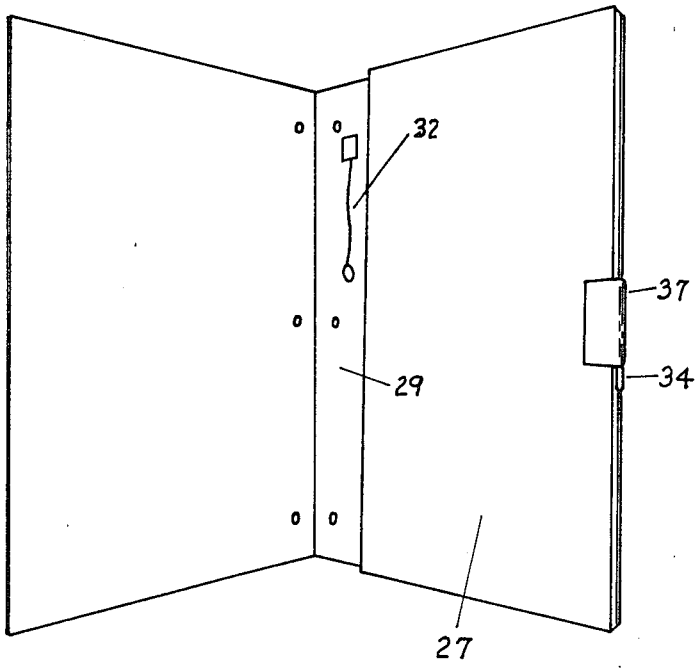
FIG. 8 shows an alternate tension band folder.

FIG. 8 shows an alternate tension band folder with an added thickness 27, tension band channel 29, tension band holder 32, lacing needle 34, and alternate lacing needle holder 37, which is a piece of paper folded over the edge of the folder.

USING THE FLACCID LACE LOOSE-LEAF BINDER

To insert paper, disconnect the tension band 28 and pull the sheet retainers 24 around through the holes until the connectors come through. Insert the paper and then pull the connectors back to their position in the tension band folder 26 and reconnect the tension band.

To adjust the tension, increase or decrease the number of times the band is wound around the hooks 30. If very few pages are in the binder, use a very small rubber band.

If many sheets are to be inserted at one time, use the lacing needle.

In a binder for three-hole binder paper, the tension band 28 is connected to the two outside retainers 24, and the middle retainer is left slack. In a large folio, use an even number of retainers with one band for every two retainers.

With a tight tension band, it is best to turn a page by turning several at one time and then turning all but one back. This only takes a moment and saves wear on the perforations. If pages are being flipped back and forth or being turned all the way around 360 degrees, it is best to disconnect the tension band 28.

Use of the back identification strip 22 is optional. Choose a strip approximately the width of the bound pages, label it, and lace the retainers 24 through the holes so that the lace will be on the inside when the flaps are folded together and taped.

While the above description contains many specificities, these should not be construed as limitations on the scope of the invention but rather as an exemplification of one preferred embodiment thereof. Many other variations and uses are possible. Accordingly, the scope of the invention should not be determined by the embodiment illustrated but by the appended claims and their legal equivalents.

I claim:

1. A loose-leaf binder for perforated paper sheets comprising, a first and second cover, each cover having a plurality of perforations proximate to an edge, at least two flaccid lace sheet retainers including a first and a second retainer, each retainer spaced apart from adjacent retainers and having connector members at opposed ends to selectively lock said opposed ends of the retainer, each retainer penetrating perforations of said first and second cover and locked at opposed ends to form an endless loop, and means for biasing each of said first and second retainers in the direction of the other, said means for biasing including an elastic band and a first and a second hook, said first hook connected to said elastic band and to the endless loop formed by said first retainer, said second hook connected to said elastic band and to the endless loop formed by said second retainer, each hook having a slit and a configuration permitting wrapping of said elastic band onto said hook, thereby altering the effective length of said elastic band.

2. The binder of claim 1 wherein said connector members of each retainer include an externally threaded male member and an internally threaded female member.

3. The binder of claim 1 wherein said perforations of said covers are aligned in a lengthwise direction and said loose-leaf binder further includes a back identification strip, said identification strip having a pair of parallel, lengthwise folds and having perforations at said folds, said retainers penetrating the perforations to bind said identification strip to said covers.

4. The binder of claim 1 further comprising an elongate lacing needle having means for selectively coupling said elongate lacing needle to a connector member.

5. The binder of claim 1 wherein said connector members of a retainer include a male member and a female member, said male member having a cog and said female member having a longitudinal groove connecting with a transverse channel, whereby the opposed ends of a retainer may be joined together and drawn smoothly through perforations in a stack of perforated sheets.

6. The binder of claim 1 further comprising a tension band folder fixed between said first and second covers, said tension band folder having a rectangular configuration and a center fold and further having a plurality of perforations proximate said center fold, said perforations spaced apart for alignment with said perforations of the covers, said retainers laced through said perforations.

7. A loose-leaf binder for perforated paper sheets comprising, a first and a second cover, each cover having a plurality of spaced apart perforations proximate to an edge, a back identification strip having a pair of parallel folds and having perforations along said folds, said perforations aligned with the perforations of said cover, at least two flaccid lace retainers, each of said lace retainers passing through aligned perforations of said first and second covers and said identification strip, each lace retainer having a male connector member and a female connector member joined together to form an endless loop, means for biasing a pair of spaced apart lace retainers toward an area between said lace retainers, said means for biasing including an elastic band and a first and a second hook, each hook connected to said elastic band and to an endless loop formed by a lace retainer of said pair of lace retainers, each hook having a slit and said elastic band wrapped through said slit at least one time, the number of wrappings about said slits of the hooks determining the effective length of said elastic band, and an elongate lacing needle having means for selectively coupling with one of said connector members of a lace retainer.

8. The binder of claim 7 further comprising a tension band folder fixed between said covers, said tension band folder having a rectangular configuration and a centerfold, said tension band folder further having a plurality of perforations proximate said centerfold, said perforations spaced apart for alignment with said perforations of the covers, said lace retainers laced through said perforations.

9. The binder of claim 7 having three lace retainers.

10. The binder of claim 7 wherein said male connector member of each lace retainer has an externally threaded portion and each female connector member has an internally threaded portion.

11. A loose-leaf binder for perforated paper sheets comprising, first and second parallel covers, each cover having a length and a width and a plurality of spaced apart perforations proximate a lengthwise edge, a back identification strip having a pair of parallel folds and having perforations along each fold, said perforations aligned with the perforations of said covers, a tension band folder positioned between said first and second covers, said tension band folder having a centerfold and a plurality of perforations proximate said centerfold, said perforations aligned with the perforations of the covers, at least two flaccid lace sheet retainers including a first and a second retainer, each retainer spaced apart from adjacent retainers and having a male connector member and a female connector member at opposed ends of the retainer, each retainer being laced through the perforations of said covers, said identification strip and said tension band folder, each retainer locked at said opposed ends to form an endless loop, means for biasing each of said first and said second retainer in the direction of the other, said means for biasing including an elastic band and a first and a second hook, said first hook connected to said elastic band and to the endless loop formed by said first retainer, said second hook connected to said elastic band and to the endless loop formed by said second retainer, each hook having a slit and a configuration permitting wrapping of said elastic band onto said hook, thereby altering the effective length of said elastic band, and an elongate lacing needle having means for selectively coupling said lacing needle to a connector member of a retainer.

12. The binder of claim 11 wherein said male connector member of a retainer includes an externally threaded portion and said female connector member includes an internally threaded portion.

13. The binder of claim 11 wherein said male connector member of a retainer has a cog and said female connector member has a longitudinal groove and a transverse channel connected to said longitudinal groove.

14. The binder of claim 11 having three retainers.

* * * * *